US006922868B1

(12) United States Patent
Jeong

(10) Patent No.: US 6,922,868 B1
(45) Date of Patent: Aug. 2, 2005

(54) UNION DEVICE FOR DUST-BOX IN CYCLONE TYPE VACUUM CLEANER

(75) Inventor: Won Chul Jeong, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/129,735

(22) PCT Filed: Mar. 16, 2000

(86) PCT No.: PCT/KR00/00220

§ 371 (c)(1),
(2), (4) Date: May 10, 2002

(87) PCT Pub. No.: WO01/35809

PCT Pub. Date: May 25, 2001

(30) Foreign Application Priority Data

Nov. 15, 1999 (KR) ..... P1999-50680
Mar. 15, 2000 (KR) ..... P2000-12960

(51) Int. Cl.[7] ..... A47L 9/16; A47L 9/10
(52) U.S. Cl. ..... 15/353; 15/352; 15/327.1
(58) Field of Search ..... 15/327.1, 327.2, 15/327.6, 350, 351, 352, 353; 55/337, 429, 55/DIG. 3

(56) References Cited

U.S. PATENT DOCUMENTS 2,535,963 A * 12/1950 Sisemore ..... 55/429
2,842,225 A * 7/1958 Wahlborg ..... 96/403
5,129,125 A * 7/1992 Gamou et al. ..... 15/352
5,779,745 A * 7/1998 Kilstrom ..... 55/337
5,935,279 A * 8/1999 Kilstrom ..... 55/337
6,589,309 B2 * 7/2003 Oh et al. ..... 55/429
6,735,816 B2 * 5/2004 Oh et al. ..... 15/353
2002/0088079 A1 * 7/2002 Oh ..... 15/352
2003/0019074 A1 * 1/2003 Oh et al. ..... 15/352
2003/0145421 A1 * 8/2003 Choi ..... 15/352

FOREIGN PATENT DOCUMENTS

| | | |
|---|---|---|
| JP | 55-70227 | 5/1980 |
| JP | 55-70228 | 5/1980 |
| JP | 58-54255 | 4/1983 |
| JP | 64-40459 | 3/1989 |

* cited by examiner

*Primary Examiner*—Terrence R. Till
(74) *Attorney, Agent, or Firm*—Fleshner & Kim LLP

(57) ABSTRACT

Device for fastening a dust box to a cyclone vacuum cleaner, including an accommodating part having a space in a body of the cyclone vacuum cleaner, a dust box mounted in the accommodating part selectively, for collecting various foreign matters separated from air, and fastening means for moving the dust box in the accommodating part in up and down directions selectively for putting, or taking the dust box into/out of the accommodating part, whereby permitting smooth putting in and taking out the dust box with simple operation, and preventing escape of various foreign matters from the dust box during putting or taking the dust box in/out of the cleaner.

27 Claims, 14 Drawing Sheets

UNION DEVICE FOR DUST-BOX IN CYCLONE TYPE VACUUM CLEANER

TECHNICAL FIELD

The present invention relates to a cyclone vacuum cleaner, and more particularly, to a device for fastening a dust box to a cyclone vacuum cleaner.

BACKGROUND OF THE RELATED ART

The cyclone vacuum cleaner is a kind of cleaner having a cyclone collector applied to a vacuum cleaner, wherein the cyclone collector uses a cyclone action in separating and collecting various foreign matters from drawn air. As shown in FIG. 1, the cyclone vacuum cleaner is provided with a vertical body 10, and a suction nozzle body 20 fastened to a lower portion of the body 10 for drawing various foreign matters, such as dust. There is a fan coupled to a motor for generating a vacuum in the cleaner body 10 when required. And, there is an accommodating part 111 in an inside of an upper portion of the body 10 for fastening a cyclone collector which separate the various foreign matters from the air drawn through the suction nozzle body 20, and collecting the foreign matters.

The cyclone collector will be explained with reference to FIGS. 2, 3A and 3B, in detail.

The cyclone collector is provided with a cyclone body 31 of a cone form, an air inlet 34 in communication with an upper portion of a side of the cyclone body 31 for drawing air and dust through the suction nozzle body 20, an air outlet tube 32 connected to a center of a top of the cyclone body 31 for discharging the air having the various foreign matters separated therefrom, and a dust box 33 connected to a bottom portion of the cyclone body 31 for collecting the dust separated from air. Thus, the cyclone body 31 has a suction force generated therein for drawing air containing various dust. The air inlet 34 is connected to a circumference of the cyclone body 31 in a tangential direction of the cyclone body 31 for subjecting the air and the various foreign matters to a centrifugal force, so that the air and various foreign matters circulate along an inside wall surface of the cyclone body 31, and separated from each other by a difference of the centrifugal force. That is, the dust with a certain mass is subjected to the centrifugal force, to drop along the inside surface of the cyclone body 31 until the dust is collected in the dust box, and the air with almost no mass is not subjected to the centrifugal force as much as the dust, to ride on a rising current formed at a central portion of an inside of the cyclone body 31 until the air is discharged through an air outlet tube 32.

In the meantime, when the various foreign matters collected in the dust box 33 through the foregoing process reaches to a maximum allowable dust collecting amount, the collected foreign matters should be removed and the dust box should be cleaned. To do this, in the related art, the dust box 33 is detachably fastened to the accommodating part 11 of the vacuum cleaner. That is, the dust box 33 has an elastic hook 33*b* below a hand grip 33*a* which is provided for handing the dust box 33, and a stop 11*a* on a bottom of the accommodating part 11 for catching the hook, for fastening a lower portion of the dust box 33. And, there is a projection 11*b* on top of the accommodating part 11, and a hole 33*c* in an upper portion of the hand grip 33*a* for being caught by the projection 11*b*, for fastening an upper portion of the dust box 33. Accordingly, when the user intends to take the dust box 33 out of the body 10, as shown in FIG. 3A, a force should be applied to the dust box 33 upward in the drawing to release the hook 33*b* from the stop 11*a* in the body 10, thereby freeing the lower portion of the dust box 33 from the accommodating part 11. Then, as shown in FIG. 3B, the dust box 33 is lifted upward, to release the hole 33*c* from the projection 11*b* on the body 10, and to free the upper portion of the dust box 33 from the body 10, thereby separating the body 10 from the dust box 33. Opposite to this, the putting the dust box 33 into the accommodating part 11 can be made in a reverse order of the taking out.

However, since the foregoing fastening between the related art cleaner body 10 and the dust box 33 is a forced hook fastening, wherein the upper or lower portion of the dust box 33 should be tilted for detaching the dust box 33, there is a possibility that various foreign matters collected in the dust box 33 can escape from the dust box 33 during the dust box 33 is detached from the body 10. Though this problem is caused mainly by a sloped top surface of the dust box 33 or a sloped top surface of the accommodating part 11, the sloped top surfaces are required for taking out, and putting in the dust box 33. This reduces a maximum dust collecting capacity of the dust box, and causes a serious problem in keeping the room clean, that drops a reliability of the product. And, the taking out, and putting in the dust box 33 are complicated as the lower portion fastening should be released at first before the upper portion fastening is released.

DISCLOSURE OF THE INVENTION

Accordingly, the present invention is directed to a device for fastening a dust box to a body of the cyclone vacuum cleaner that substantially obviates one or more of the problems due to limitations and disadvantages of the related art.

An object of the present invention is to provide a device for fastening a dust box to a body of the cyclone vacuum cleaner, which permits smooth taking out, and putting in of a dust box.

Another object of the present invention is to provide a device for fastening a dust box to a body of the cyclone vacuum cleaner, which can maximize an allowable dust collecting capacity, and prevent escape of various foreign matters from the dust box during the dust box is taken out of the body.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for fastening a dust box to a cyclone vacuum cleaner includes an accommodating part having a space in a body of the cyclone vacuum cleaner, a dust box mounted in the accommodating part selectively, for collecting various foreign matters separated from air, and fastening means for moving the dust box in the accommodating part in up and down directions selectively for putting, or taking the dust box into/out of the accommodating part.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
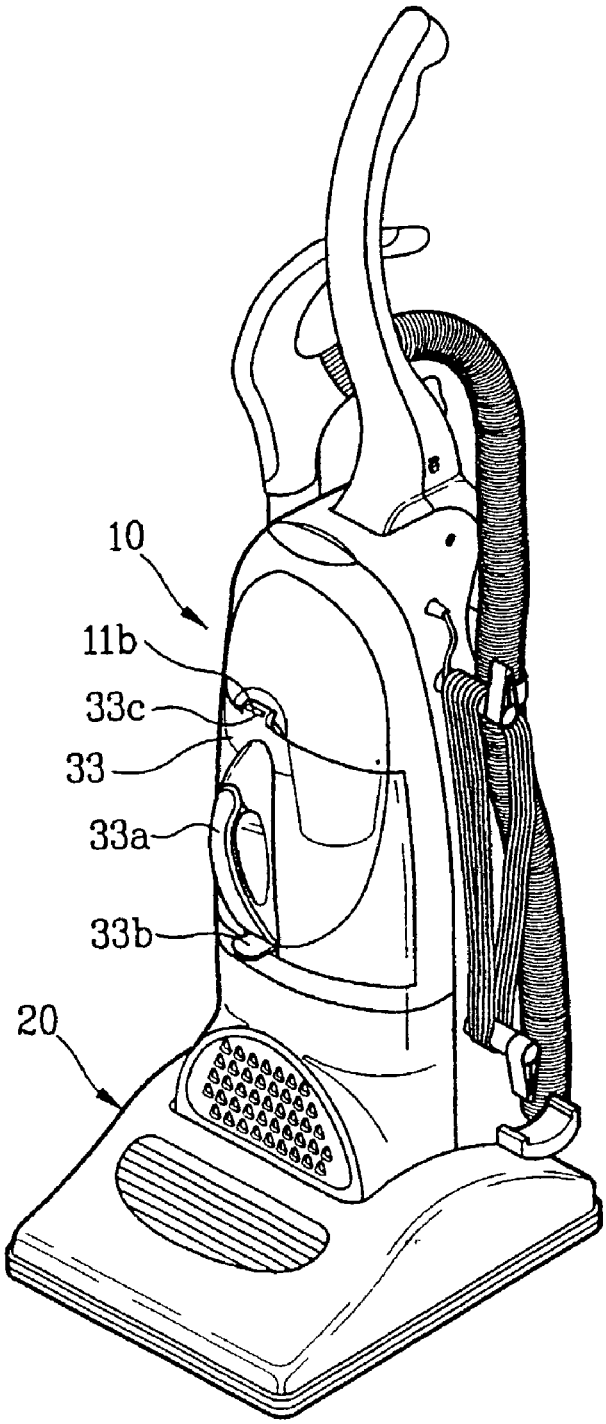
FIG.1 Prior Art
FIG. 1 illustrates a perspective view of a related art cyclone vacuum cleaner.
Figure 2:
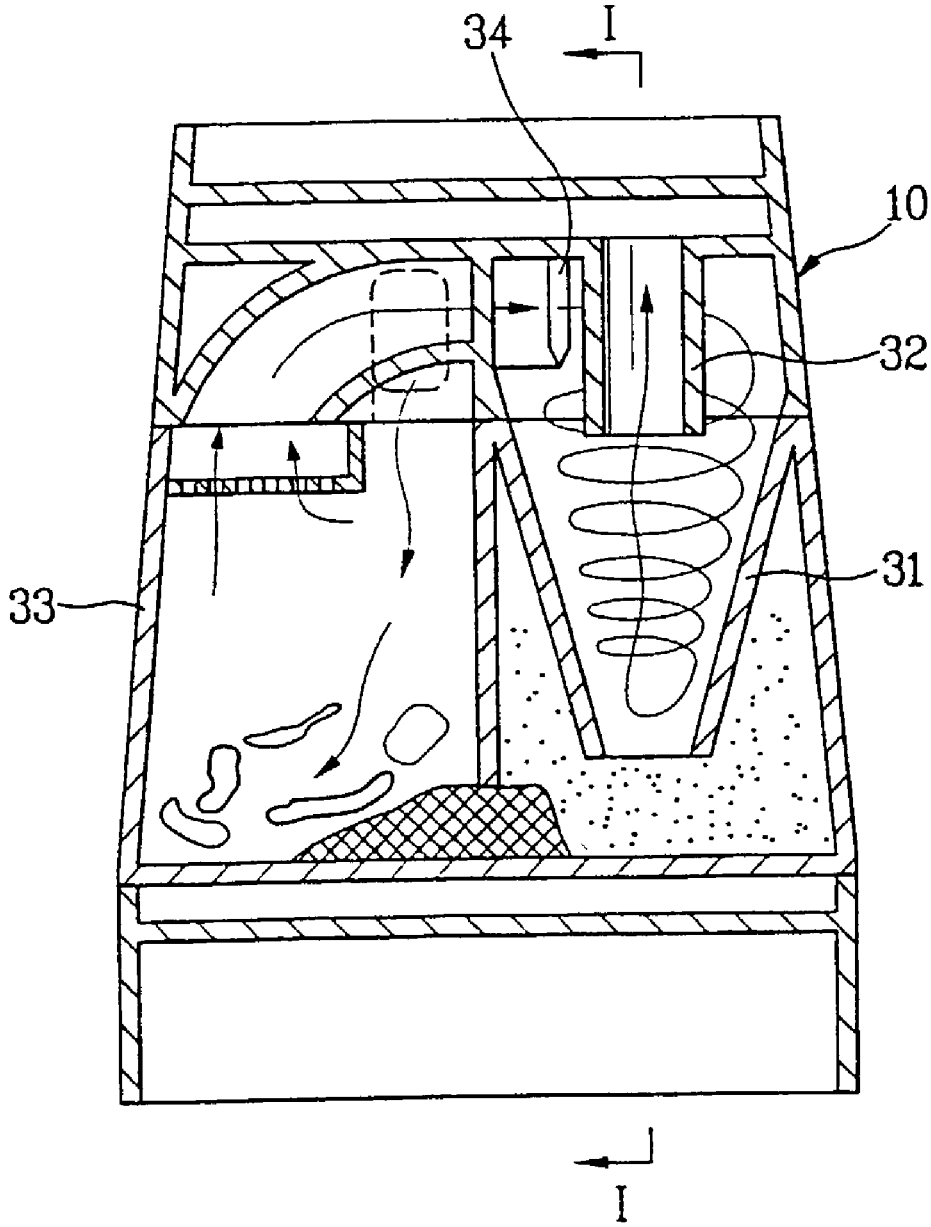
FIG. 2 Prior Art
FIG. 2 illustrates a frontal section of key parts of a cyclone collector in a related art cyclone vacuum cleaner.
Figure 3A:
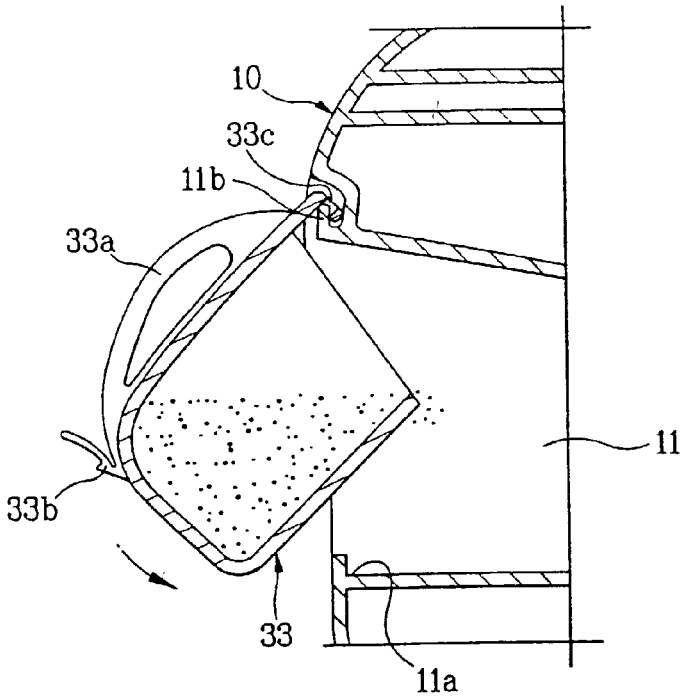
FIG.3A Prior Art
FIGS. 3A and 3B illustrate sections across line I—I in FIG. 2 showing the steps of putting a dust box into an accommodating part in a related art cyclone vacuum cleaner, schematically.
Figure 3B:
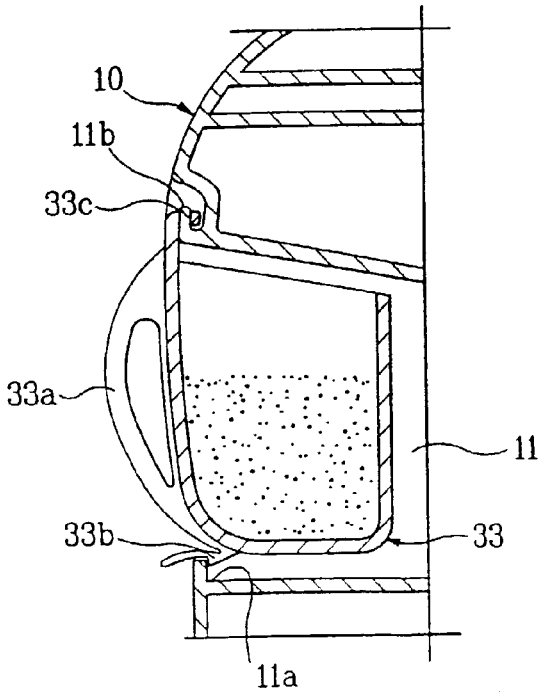
FIG.3B Prior Art
Figure 4:
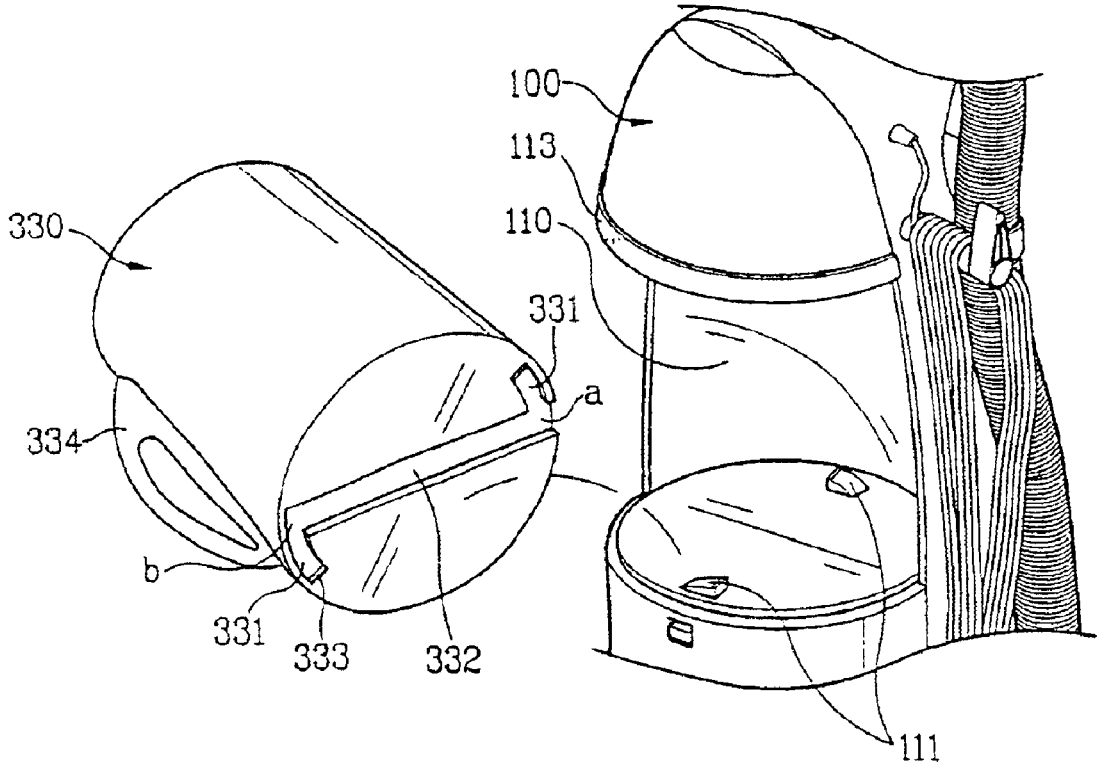
FIG. 4 illustrates a disassembled perspective view of key parts showing a taking out-putting in structure formed between an accommodating part of a cyclone collector and a dust box in accordance with a first preferred embodiment of the present invention, schematically.
Figure 5:
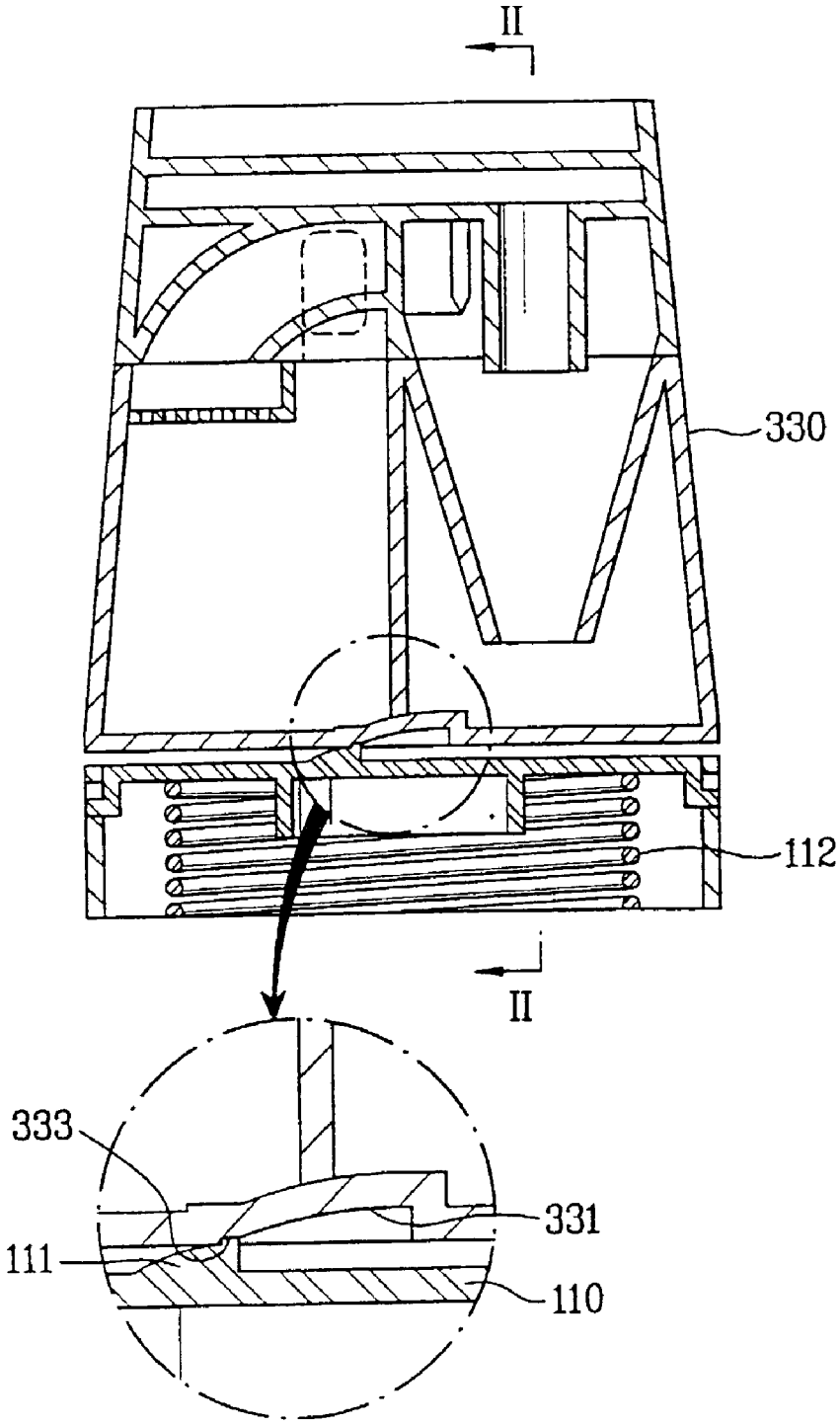
FIG. 5 illustrates a frontal section of key parts of a cyclone collector in accordance with a first preferred embodiment of the present invention.

Reference will now be made in detail to the preferred embodiments of the present invention, examples of which are illustrated in the accompanying drawings. A first preferred embodiment of the present invention will be explained with reference to FIGS. 4~6A, 6B. FIG. 4 illustrates a disassembled perspective view of key parts showing a taking out-putting in structure formed between an accommodating part of a cyclone collector and a dust box in accordance with a first preferred embodiment of the present invention schematically, and FIG. 5 illustrates a frontal section of key parts of a cyclone collector in accordance with a first preferred embodiment of the present invention.

That is, the fastening means in accordance with a first preferred embodiment of the present invention includes at least one projection on a bottom of an accommodating part 10 of a cleaner body 100, and a recess 331 in the dust box 330 at a position opposite to the projection 111, wherein the projection 111 and the recess 331 are sloped opposite to each other in direction of coupling. A bottom of the accommodating part 110 may be supported by a spring 112 elastically, for always keeping the dust box 330 mounted in the accommodating part 110 supported. And, the projection 111 and the recess 331 are formed at positions opposite to each other for making the dust box supported from opposite sides of the bottom of the dust box, for stable support when dust box 330 is put in the accommodating part 110. And, during the dust box 330 is put into the accommodating part, insertion of the dust box 330 may be interfered by the projection 111. Therefore, there is a guide groove 332 in a bottom surface of the dust box 330 formed along a direction insertion of the dust box 330 is to be made. The guide groove 332 is formed starting from a side 'a' insertion of the dust box 330 into the accommodating part 110 is started extended to a side 'b' the insertion of the dust box 330 is completed. And, the guide groove 332 connects deepest portions of the recesses 331 in the dust box 330. That is, the guide groove formed such that portions of the recesses 331 at which the projections 111 make an initial stop are connected. In the meantime, when there is an external impact applied to the dust box 330 during cleaning, the projections 111 on the accommodating part 110 may be come out of the recesses 331. As a countermeasure to this, the recess 331 is formed such that an insertion starting portion insertion of the projection is started therefrom is deep enough to accommodate the projection 111 fully, and another portion opposite to the insertion starting portion is sloped along a circumference of the bottom of the dust box 330 to a height not to be brought into contact with a bottom of the dust box 330. And, a setting slot 333, or shoulder, is extended starting from an end of the recess 331 at which the slope ends to a distance, for preventing movement of the projection 111 in a state the dust box 330 is fastened to the accommodating part 110, completely. The dust box 330 is cylindrical in overall, and an inside of the accommodating part 110 in which the dust box 330 is set is also formed cylindrical to match with the form of the dust box 330, for smooth rotation of the dust box 330 in the accommodating part 110, and preventing movement between the accommodating part 110 and the dust box 330 to the maximum. And, there is a rim 113 around a top circumference of the accommodating part 110, not only for preventing movement of the dust box 330, but also closing a gap between the accommodating part 110 and the dust box 330 as an upper circumference of the dust box 330 is covered by the rim 113 when the dust box 330 is moved upward in the accommodating part 110.

A process for fastening the aforementioned dust box in accordance with a first preferred embodiment of the present invention will be explained with reference to FIGS. 6A and 6B in detail.

Figure 6A:
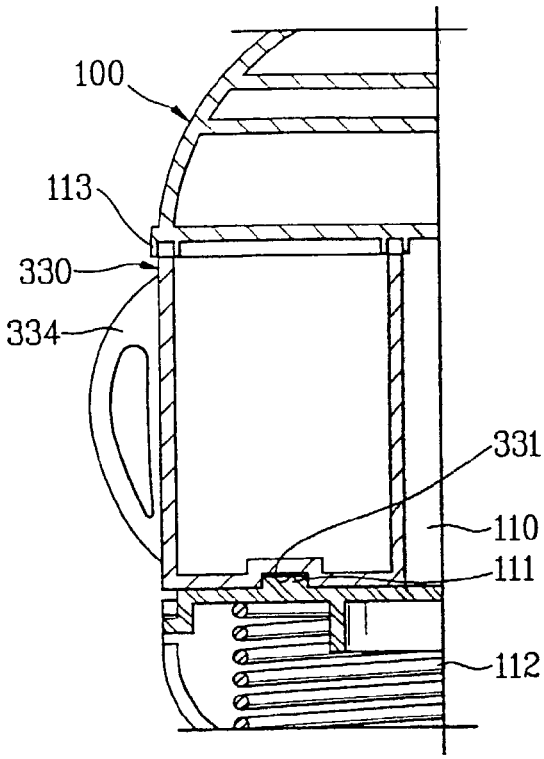
FIGS. 6A and 6B illustrate sections across line II—II in FIG. 5 showing the steps of putting a dust box into an accommodating part in accordance with a first preferred embodiment of the present invention, schematically.
Figure 6B:
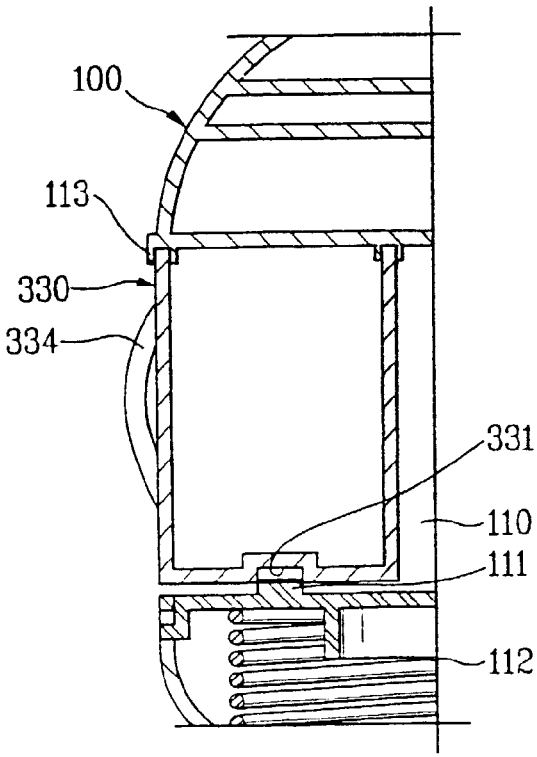
Figure 7:
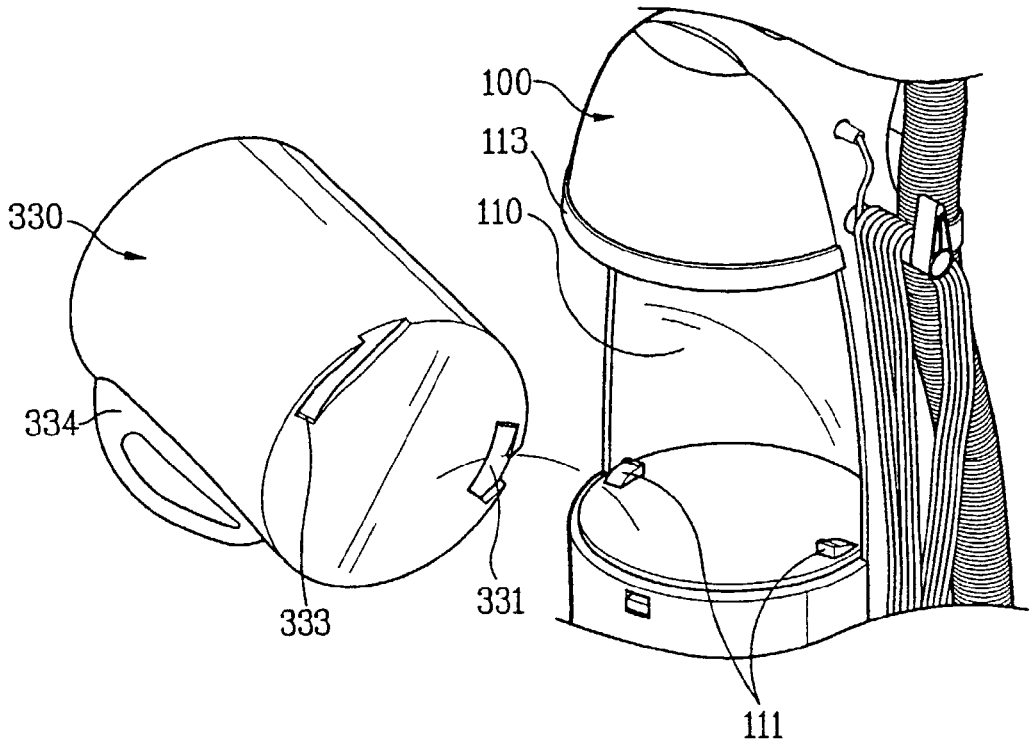
FIG. 7 illustrates a key part disassembled perspective view showing another form of FIG. 4.

Referring to FIG. 6A, the dust box 330 is inserted into the accommodating part 110, to insert the projection 111 on the accommodating part 110 into inside of the guide groove 332, and continuous to this, position the projections 111 in respective recesses 331 of the dust box 330. Once the dust box 330 is set in the accommodating part 110, the dust box 330 is rotated in a left (or right) direction by using the hand grip 334 on an outside surface of the dust box 330, so that, as shown in FIG. 6B, the dust box 330 moves upward until the dust box 330 is fastened in the accommodating part 110. That is, the dust box 330 is rotated, so that the dust box 330 moves upward as the projections 111 in the deepest portions of the recesses 331 gradually move toward the setting slot 333 extended from the recesses 331. This is possible because a portion between the recess 331 and the setting slot 333 and the projection 111 are sloped, oppositely. In this instance, a top rim of the dust box 330 is gradually inserted into the rim 113 around the top circumference of the accommodating part 110, to close a gap between the dust box 330 and the accommodating part 110. Due to this, the dust box 330 is mounted into the accommodating part 110 exactly, to prevent escape of the various foreign matters in the dust box 330 during cleaning. And, as the bottom of the accommodating part 110 is elastically supported by the spring 112, a stable mounting of the dust box 330 is maintained as far as there is no separate force applied thereto. In the meantime, when it is intended to take the dust box 330 out of the accommodating part 110, the dust box 330 is rotated in a direction opposite to a direction the dust box 330 is rotated for fastening the dust box 330. That is, when the dust box 330 is rotated in a right direction on the drawing, the projections 111 come out of respective setting slots 333, and the slopes of the recesses 331 slide along the projections 111, until the projections 111 reach to the deepest portions of the recesses 33. Due to this, the dust box 330 moves downwardly, to permit the top of the dust box 330 comes out of the rim 113 of the accommodating part 110. Then, by pulling the dust box 330 out of the body 100 of the cleaner, taking the dust box 330 out of the cleaner body 100 is completed. In the meantime, as shown in FIG. 7, the projections 111 and the recesses 331 may be respectively formed on both sides of the bottom of the accommodating part 110 and both sides of the bottom of the dust box 330, detailed explanations of which will be omitted.

Figure 8:
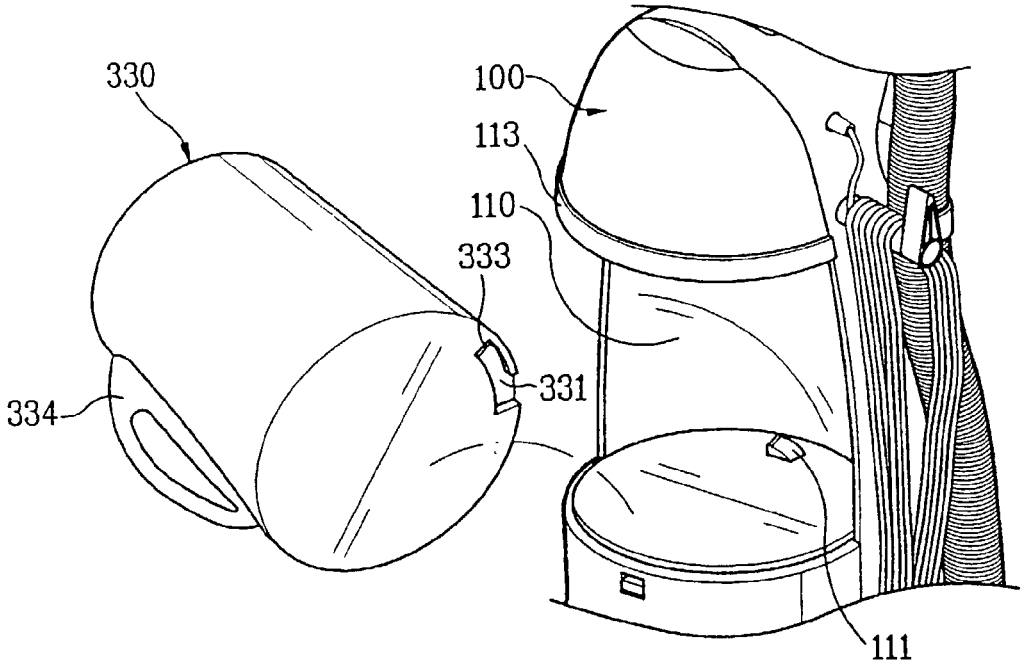
FIG. 8 illustrates a disassembled perspective view of key parts showing a taking out-putting in structure formed between an accommodating part of a cyclone collector and a dust box in accordance with a second preferred embodiment of the present invention, schematically.

FIG. 8 illustrates a disassembled perspective view of key parts showing a taking out-putting in structure formed between an accommodating part of a cyclone collector and a dust box in accordance with a second preferred embodiment of the present invention, schematically. In the second embodiment of the present invention, a projection 111 is formed on a bottom of inside of the accommodating part 110, and the recess 331 is formed in a bottom of the dust box 330 opposite to the projection 111. The recess 331 is formed to elongate from a side insertion of the projection 111 is started along a bottom circumference of the dust box 330. And, the recess 331 is gradually sloped along a direction of rotation of the dust box 330 until the height of the slope is the same with a height of the bottom of the dust box 330.

Figure 9:
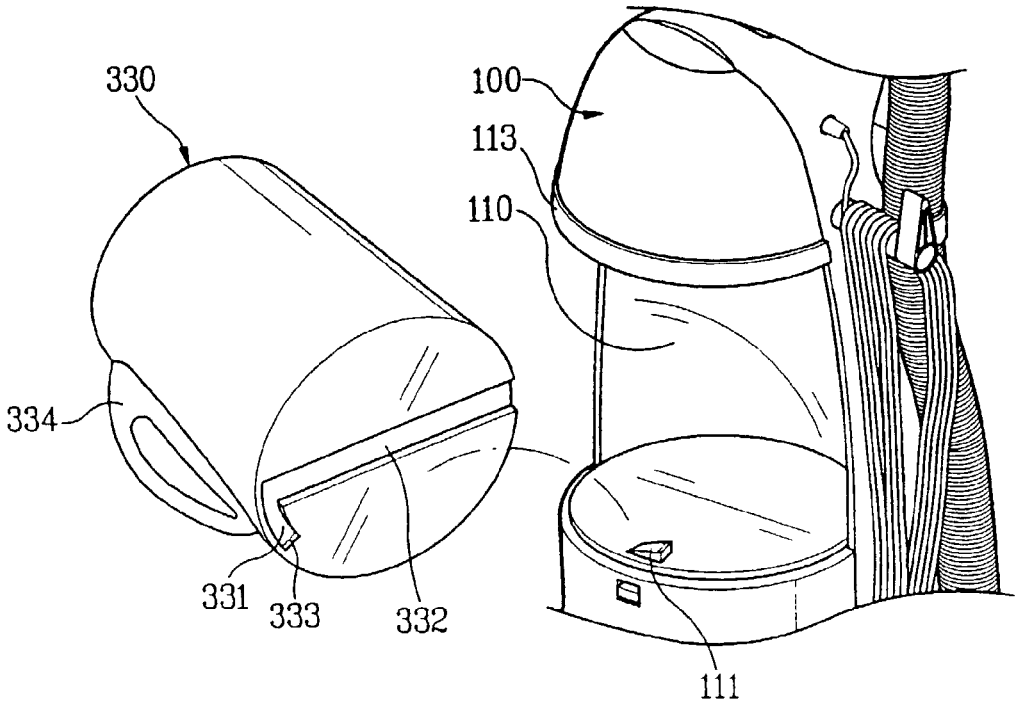
FIG. 9 illustrates a disassembled perspective view of key parts showing a taking out-putting in structure formed between an accommodating part of a cyclone collector and a dust box in accordance with a third preferred embodiment of the present invention, schematically.
Figure 10:
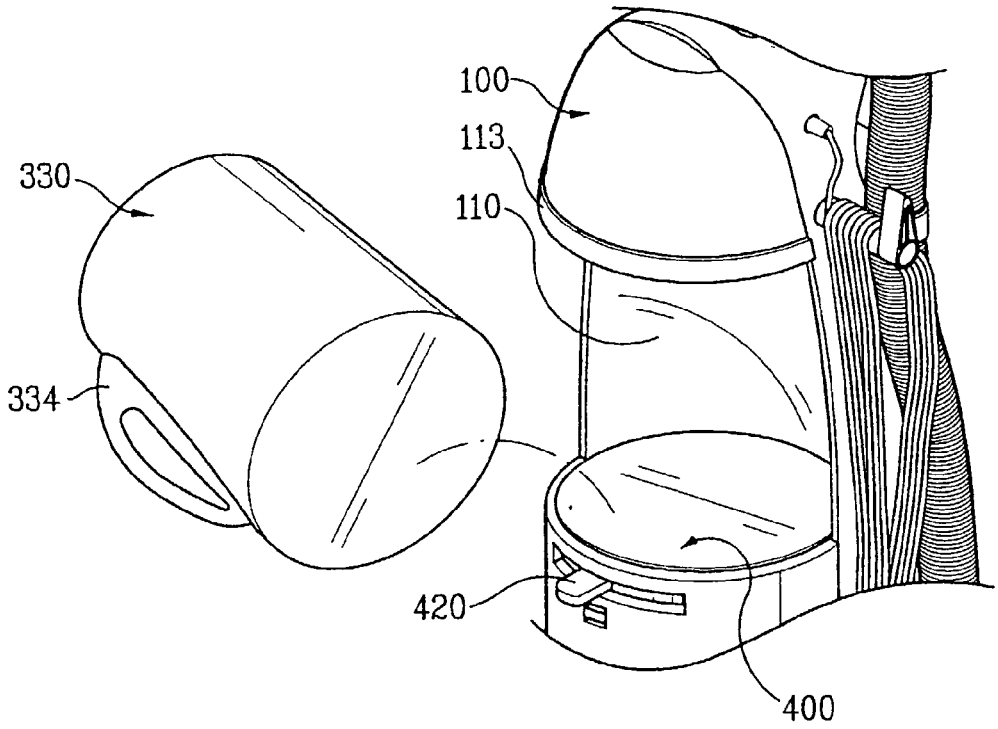
FIG. 10 illustrates a disassembled perspective view of key parts showing a taking out-putting in structure formed between an accommodating part of a cyclone collector and a dust box in accordance with a fourth preferred embodiment of the present invention, schematically.
Figure 11:
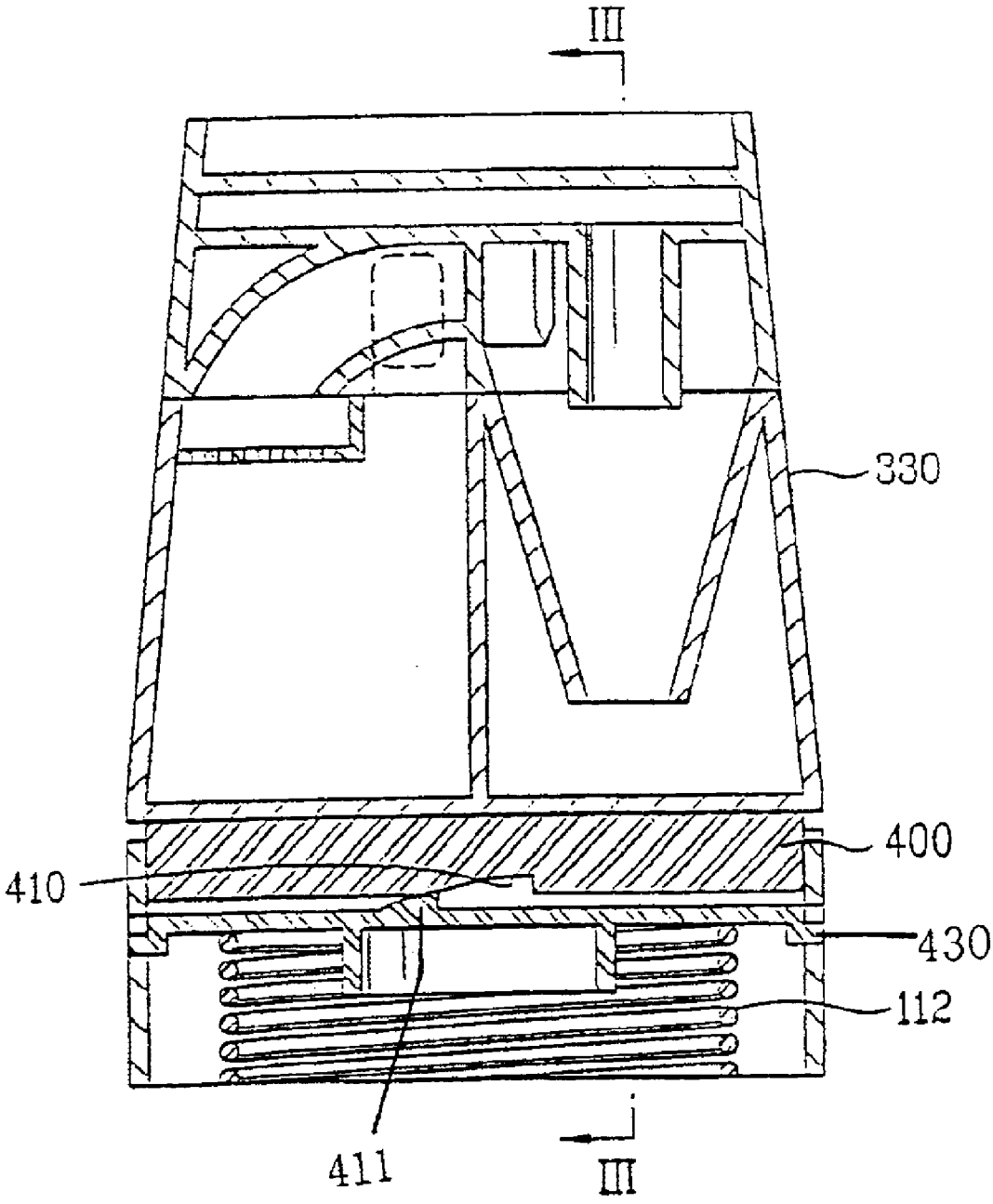
FIG. 11 illustrates a frontal key part section of a cyclone collector in accordance with a fourth preferred embodiment of the present invention.
Figure 12A:
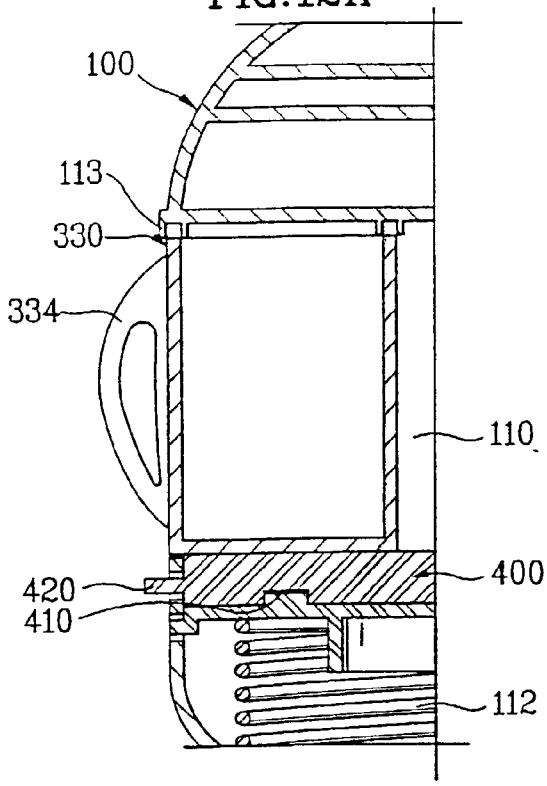
FIGS. 12A and 12B illustrate sections across line III—III in FIG. 11 showing the steps of putting a dust box into an accommodating part in accordance with a fourth preferred embodiment of the present invention, schematically.
Figure 12B:
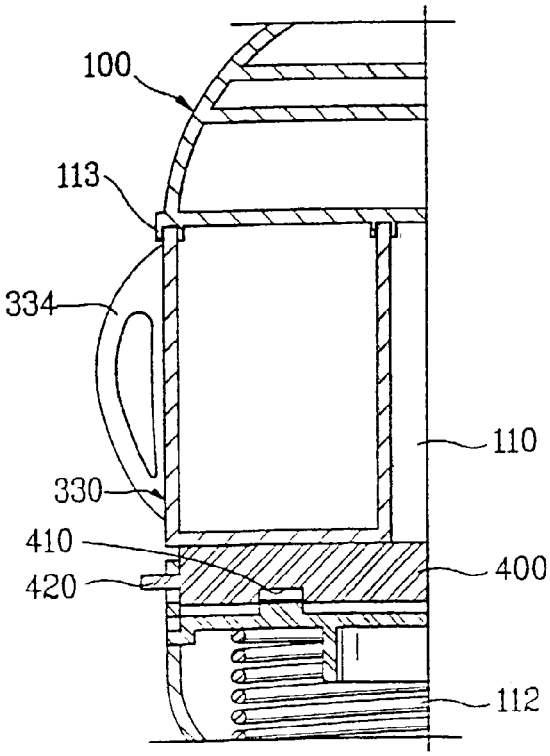

FIG. 9 illustrates a disassembled perspective view of key parts showing a taking out-putting in structure formed between an accommodating part of a cyclone collector and a dust box in accordance with a third preferred embodiment of the present invention, schematically. The third embodiment has a structure opposite to the structure of the second embodiment. That is, in the third embodiment, a projection 111 is formed on a portion of a bottom of the accommodating part 110 at which insertion of the dust box 330 is started, and the recess 331 is formed in a bottom of the dust box 330 opposite to a position of the projection 111. In this instance too, the recess 331 is formed elongated from a side the projection is inserted along a bottom circumference of the dust box 330, and the recess 331 is gradually sloped along a direction of rotation of the dust box 330 until the height of the slope becomes the same with a height of the bottom of the dust box 330.

In the meantime, though not shown, in the structures in respective embodiments of the present invention, the projection 111 may be formed on a center of the bottom of the accommodating part 110, and the recess 331 is formed in a center of the bottom of the dust box 330 in a opposite position to the projection 111.

FIGS. 10~12A, 12B illustrate a fourth embodiment of the present invention.

In the fourth embodiment of the present invention, the dust box 330 is put in the accommodating part 110, not by rotating the dust box 330, but by moving the dust box 330 upward by means of separate structure, and is taken out of the accommodating part 110 by moving the dust box 330 downward by means of the separate structure. In order to do this, a moving part 400 and a guide part 430 are provided for fastening and moving the dust box 330 in up and down directions in the accommodating part 110, and fastening means between a bottom of the moving part 400 and a bottom of the accommodating part 110 for moving the moving part 400 in up and down directions, selectively. The fastening means has a basic system similar to the sloped projection 111 and the recess 331 in the foregoing embodiments of the present invention. That is, projections 411 are formed on the top of the guide part 430 oppositely, and the recesses 410 are formed in the bottom of the moving part 400 to accommodate the projections 411. Alike the first embodiment, it is preferable that the recesses 410 and the projections 411 are formed to have slopes in directions the recesses 410 and the projections 411 are coupled. And, there is a handling part 420 on an outside circumference of the moving part 400 for easy handling of the moving part 400. When it is intended to put the dust box 330 in the accommodating part 110, the dust box 330 is placed in the accommodating part 110 at first, to place the dust box 330 on the moving part 400. Under this condition, the handling part 420 is operated, to rotate the moving part 400 in one side. Upon rotation of the moving part 400, the recess 410 in the bottom of the moving part 400 gradually moves upward as the recess 410 slides on a top surface of the projections 411 when the recess 410 is moved along the direction of the rotation of the moving part 400. This is possible because the recess 410 is formed to have a height the same with a height of a surface of the moving part along a direction of rotation of the moving part, gradually. Owing to this, a top end of the dust box 330 is accommodated in the rim 113 of the accommodating part 110, to complete mounting of the dust box 330. And, when it is intended to take the dust box 330 out of the accommodating part 110, the handling part is rotated in a direction opposite to a direction of rotation in the putting the dust box 330 in the accommodating part 110. According to this, the moving part 400 is rotated, to move the recess downward gradually as the recess 410 slides on a top surface of the projection 411 when the recess 410 moves along the direction of rotation of the moving part 400. Due to this, the top of the dust box 330 comes out of the rim 113 of the accommodating part 110 gradually, to complete taking out of the dust box. Both the recess 410 and the projection 411 may be sloped. They may taper in a circumferential direction. The guide part 430 may be elastically supported by a spring 112.

Figure 13:
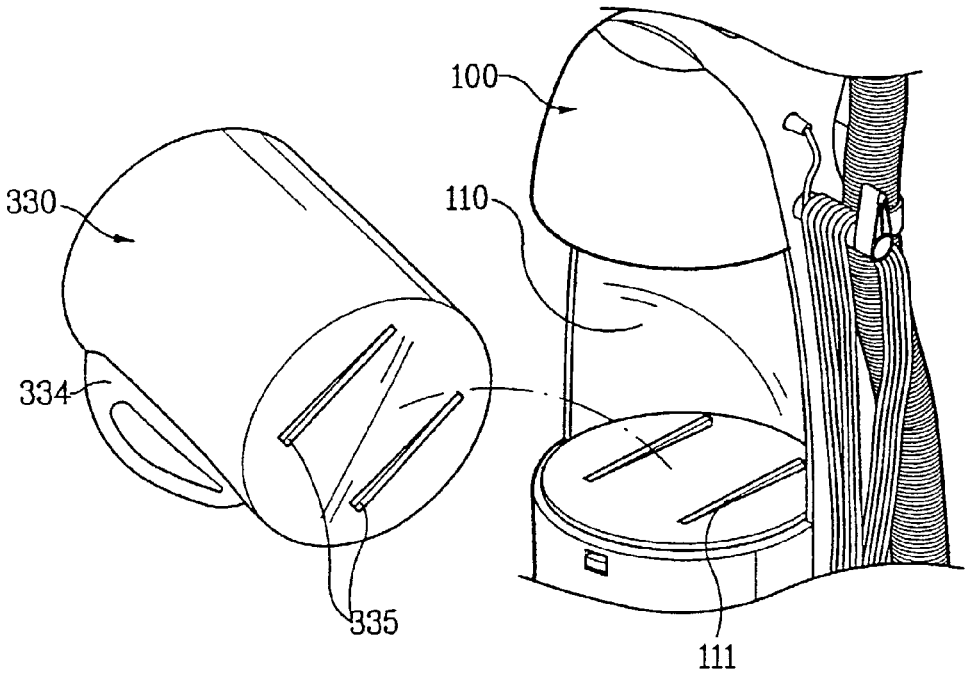
FIG. 13 illustrates a disassembled perspective view of key parts showing a taking out-putting in structure formed between an accommodating part of a cyclone collector and a dust box in accordance with a fifth preferred embodiment of the present invention, schematically.
Figure 14:
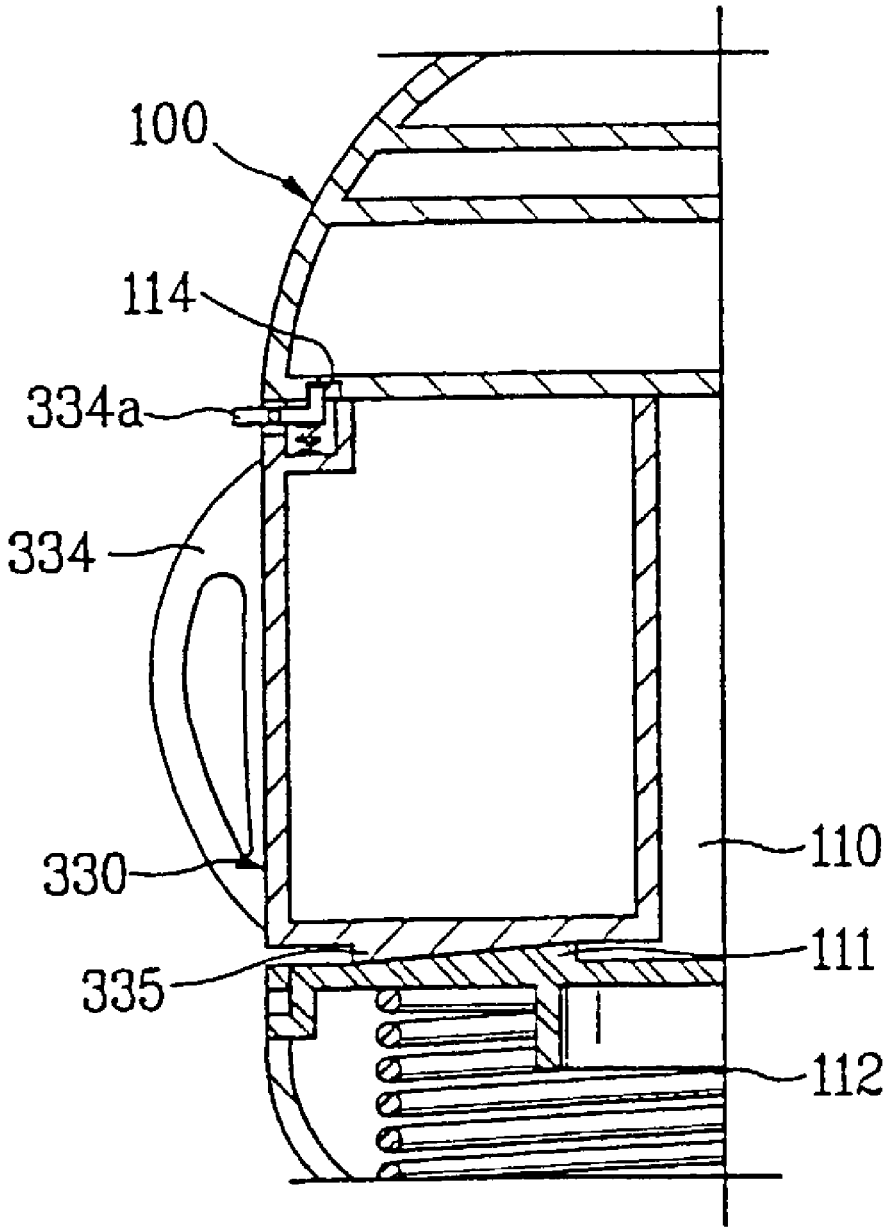
FIG. 14 illustrates a section showing a dust box put in an accommodating part in accordance with a fifth embodiment of the present invention, schematically; and, FIG. 15 illustrates a key part disassembled perspective view showing a state in which the fifth embodiment of the present invention applied to a canister type cyclone vacuum cleaner.

FIGS. 13 and 14 illustrate a fifth embodiment of the present invention.

In the fifth embodiment of the present invention, mere pushing of the dust box 330 into the accommodating part 110 completes putting in the dust box in the accommodating part. To do this, in the fifth embodiment of the present invention, projections 111 sloped gradually the more upwardly as it goes the farther toward inside of the accommodating part 110 are formed on the bottom of the accommodating part 110, and opposite projections 335 sloped gradually the more downwardly as it goes the more toward front of the accommodating part 110 are formed on the bottom of the dust box 330. In this instance, the projections 111 and the opposite projections 335 are formed at opposite positions, for making the upward or downward movement of the dust box 330 as the projections 111 and 335 are brought into contact and slide on each other. The projections 111 and 335 are formed in pair on the bottoms of the accommodating part 110 and the dust box 330 respectively, for providing a stable mounting of the dust box 330. And, in the fifth embodiment of the present invention, a hook 334*a* is provided elastically at an upper portion of the hand grip 334 on the dust box 330, and a stop 114 at an upper portion of the accommodating part 110 opposite to the hook 334*a* for more stable mounting of the dust box 330. Accordingly, when the dust box 330 is inserted into the accommodating part 110, the pair of opposite projections 335 on the bottom of the dust box 330 moves sliding on the projections 111 on the bottom of the accommodating part 110. In this instance, as the projections 111 are sloped gradually upward as it goes the farther toward inside of the accommodating part 110, and the opposite projections 335 are sloped in symmetry to the projections 111, the deeper the dust box 330 is inserted, the higher the dust box 330 moves upward within the accommodating part 110. During this process, the hook 334*a* at the top of the dust box 330 is caught by the stop 114 at the accommodating part 110, to fasten the dust box 330. And, when it is intended to take the dust box 330 out of the accommodating part 110, merely the hook 334*a* is pressed upward, to release the hook 334*a* from the stop 114, and, on the same time, to take the dust box 330 out of the accommodating part 110. According to this, the dust box 330 moves down gradually, until the dust box 330 is taken out of the accommodating part 110. In this instance, the dust box 330 gradually moves down because of the opposite projections 335 on the bottom of the dust box 330 and the projections 111 on the bottom of the accommodating part 110. That is, the projections 111 are sloped downwardly as it goes closer to an entrance of the accommodating part 110.

Figure 15:
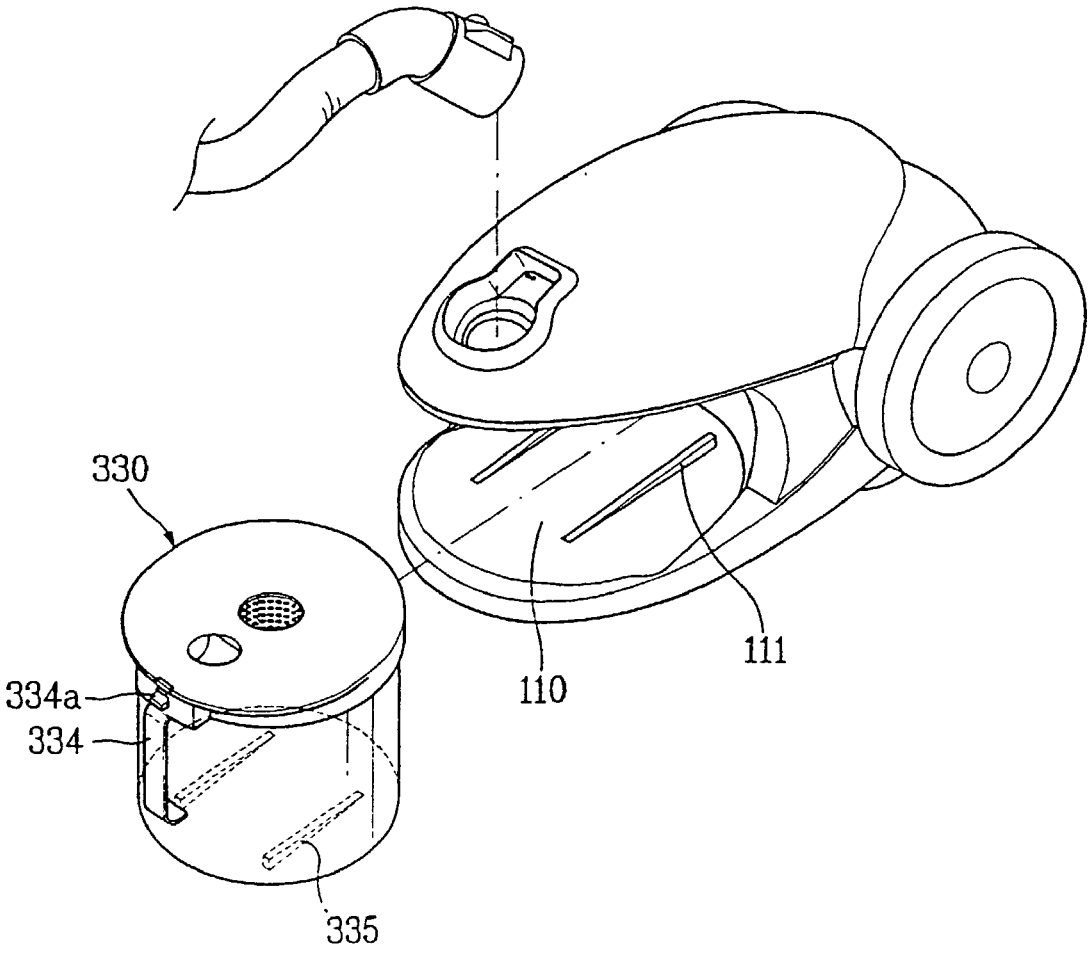

The device for fastening a dust box to a cyclone collector of the present invention is applicable, not only to an upright type cyclone vacuum cleaner, but also to a canister type cyclone vacuum cleaner as shown in FIG. 15.

It will be apparent to those skilled in the art that various modifications and variations can be made in the device for fastening a dust box to a body of the cyclone vacuum cleaner of the present invention without departing from the spirit or scope of the invention. Thus, it is intended that the present invention cover the modifications and variations of this invention provided they come within the scope of the appended claims and their equivalents.

As explained, the device for fastening a dust box to a cyclone vacuum cleaner of the present invention has a simple operation for mounting a dust box into an accommodating part.

The up and down direction putting in and taking out of the dust box permits to prevent escape of the various foreign matters from the dust box through a gap between top of the dust box and top of the accommodating part, that in turn permits to maximize an allowable dust collecting capacity of the dust box, which lengthens a frequency of the dust box cleaning. And, this also permits to prevent escape of the various foreign matters during taking out the dust box that permits to keep the room clean.

Thus, the device for fastening a dust box to a cyclone vacuum cleaner of the present invention is very useful in the industry.

What is claimed is:

1. A device for fastening a dust box to a cyclone vacuum cleaner comprising:

an accommodating part having a space in a body of the cyclone vacuum cleaner, wherein at least one sloped projection is formed on the accommodating part;

a dust box mounted in the accommodating part selectively, for collecting various foreign matters separated from air, wherein at least one dust box sloped surface is formed on the dust box at a position corresponding to the position of the sloped projection on the accommodating part, and wherein movement of the dust box relative to the accommodating part causes the dust box sloped surface to bear against the sloped projection to thereby cause the dust box to move in up and down directions.

2. A device as claimed in claim 1, wherein the at least one sloped projection is located on a bottom of the accommodating part, and wherein the sloped projection extends along a direction of coupling, and wherein the at least one dust box sloped surface is located within a recess for accommodating the sloped projection.

3. A device as claimed in claim 2, wherein the at least one dust box sloped surface in the recess reaches a height that is approximately the same with a bottom surface of the dust box.

4. A device as claimed in claim 2, wherein the at least one sloped projection is formed at a side of the bottom of the accommodating part, wherein the recess is formed such that the at least one sloped projection can be inserted in the recess when the dust box is fully set in the accommodating part, and wherein the recess helps to guide movement of the dust box relative to the accommodating part.

5. A device as claimed in claim 1, wherein both the dust box and inside space of the accommodating part are substantially cylindrical so that both are matched.

6. A device as claimed in claim 5, wherein the at least one sloped projection and the at least one dust box sloped surface extend in a circumferential direction of the accommodating part and dust box, respectively, such that rotation of the dust box relative to the accommodating part causes up and down movement of the dust box relative to the accommodating part.

7. A device as claimed in claim 6, where the at least one sloped projection comprises a plurality of sloped projections that are equally spaced around a circumference of the accommodating part, and wherein the at least one dust box sloped surface comprises a plurality of sloped surfaces that are spaced evenly around a circumference of the dust box.

8. A device as claimed in claim 7, wherein the plurality of dust box sloped surfaces are located in recesses formed on the dust box.

9. A device as claimed in claim 8, wherein a recess is formed across a diameter of the dust box to allow the dust box to be inserted into the accommodating part past a sloped projection located at a front of the accommodating part.

10. A device as claimed in claim 6, wherein a shoulder is formed on the at least one sloped projection and a corresponding shoulder is formed on the at least one dust box sloped surface, and wherein the shoulders are configured to bear against one another to limit rotation of the dust box relative to the accommodating part.

11. A device as claimed in claim 1, wherein the accommodating part includes an elastically mounted bottom for permitting up and down direction movements along an inside of the accommodating part.

12. A device as claimed in claim 1, further comprising a rim around a top surface of the accommodating part for covering a top circumference of the dust box, for closing a gap formed between the top surface of the accommodating part and the top circumference of the dust box when the dust box is fastened to the accommodating part.

13. A vacuum cleaner comprising:

an accommodating part forming a space in a body of the cyclone vacuum cleaner, wherein the accommodating part accommodates a dust box;

a moving part provided to a bottom portion of the accommodating part and having a first sloped portion, for selectively fastening the dust box to the accommodating part by moving in an upward direction and exerting a force to a bottom of the dust box; and a guide part having a second sloped portion corresponding to the first sloped portion, wherein the moving part and the guide part move relative to each other and the first sloped portion and the second sloped portion bear against each other such that the moving part moves in an upward or downward direction.

14. The vacuum cleaner of claim 13, wherein the moving part is provided on the guide part.

15. The vacuum cleaner of claim 14, wherein the first sloped portion comprises at least one first sloped surface formed on a bottom of the moving part, and the second sloped portion comprises at least one second sloped surface formed on a top surface of the guide part.

16. The vacuum cleaner of claim 15, wherein at least one recess having the at least one first sloped surface is formed on the bottom of the moving part.

17. The vacuum cleaner of claim 13, wherein the moving part and the guide part rotate relative to each other such that the moving part moves in an upward or downward direction.

18. The vacuum cleaner of claim 17, wherein the moving part is provided on the guide part.

19. The vacuum cleaner of claim 18, wherein the first sloped portion comprises at least one first sloped surface on a bottom of the moving part and tapering in a circumferential direction, and the second sloped portion comprises at least one second sloped surface formed on a top surface of the guide part and tapering in a circumferential direction.

20. The vacuum cleaner of claim 19, wherein at least one recess having the at least one first sloped surface is formed on the bottom of the moving part.

21. The vacuum cleaner of claim 13, wherein the moving part is provided on the guide part and the guide part is elastically supported by a spring.

22. The vacuum cleaner of claim 13, further comprising a handling lever provided on an outer side of the moving part so as to handle the movement of the moving part.

23. A vacuum cleaner comprising:

an accommodating part forming a space in a body of the cyclone vacuum cleaner, wherein the accommodating part accommodates a dust box;

a moving part provided to a bottom portion of the accommodating part and having at least one first sloped surface formed on a bottom of the moving part, for selectively fastening the dust box to the accommodating part by moving in an upward direction and exerting a force to a bottom of the dust box;

a guide part provided under the moving part and having at least one second sloped surface formed on a top surface of the guide part, the at least one second sloped surface corresponding to the at least one first sloped surface, respectively, wherein the moving part and the guide part move relative to each other and the at least one first sloped surface and the at least one second sloped surface bear against each other such that the moving part moves in an upward or downward direction; and a handling lever connected to one of the moving part and the guide part so as to handle the movement of the moving part.

24. The vacuum cleaner of claim 23, wherein the moving part and the guide part rotate relative to each other such that the moving part moves in an upward or downward direction.

25. The vacuum cleaner of claim 24, wherein the at least one first sloped surface tapers in a circumferential direction, and the at least one second sloped surface tapers in a circumferential direction.

26. The vacuum cleaner of claim 25, wherein at least one recess having the at least one first sloped surface is formed on the bottom of the moving part and at least one projection having the at least one second sloped surface is formed on the top surface of the guide part.

27. The vacuum cleaner of claim 23, wherein the moving part is provided on the guide part and the guide part is elastically supported by a spring.

* * * * *